United States Patent [19]

Spector

[11] Patent Number: 5,071,123

[45] Date of Patent: Dec. 10, 1991

[54] TOY IMPLEMENTS FOR STORING AND STRIKING PLAY BALLS

[76] Inventor: Donald Spector, 380 Mountain Rd., Union City, N.J. 07087

[21] Appl. No.: 586,235

[22] Filed: Sep. 21, 1990

[51] Int. Cl.[5] ..... A63B 59/00

[52] U.S. Cl. ..... 273/72 R; 273/67 R; 273/73 R; 273/77 R; 273/80 R; 446/76

[58] Field of Search ..... 273/72, 26, 25, 67, 273/73 R, 77 R, 80 R, 80 C, 80.1; 224/901; 446/76

[56] References Cited

U.S. PATENT DOCUMENTS

| | | | |
|---|---|---|---|
| 514,420 | 2/1894 | Jacobus | 273/72 R |
| 3,115,342 | 12/1963 | Webster | 273/26 B |
| 3,116,926 | 1/1964 | Owen et al. | 273/72 R |
| 3,236,521 | 2/1966 | Knott | 273/26 B |
| 3,479,030 | 11/1969 | Merola | 273/72 A |
| 3,819,179 | 6/1974 | Ambler, Jr. et al. | 273/26 B |
| 4,040,229 | 8/1977 | Candor | 273/26 R |
| 4,505,479 | 3/1985 | Souders | 273/72 A |

*Primary Examiner*—Edward M. Coven

*Attorney, Agent, or Firm*—Michael Ebert

[57] ABSTRACT

A hand-held hollow toy implement such as a toy baseball bat, adapted to store as well as to strike a play ball. To manufacture this implement, it is molded from a single piece of light-weight material to define a hollow shank section having a cavity therein, the shank section being provided with a handle at its lower end and a neck at its upper end functioning as one element of a two-element coupler, and a head section whose configuration is dictated by the end use of the implement, the head section being provided at its lower end with the complementary second element of the coupler. In the manufactured piece, the upper end of the shank section is joined by a collar integral therewith to the lower end of the head section. The manufactured piece is converted into the toy implement by cutting off the collar to separate the head section from the shank section, thereby exposing the cavity and making it possible to intercouple the sections. The cavity is usable to store one or more playballs, a weighted insert to impart heft to the implement, or other small articles.

7 Claims, 3 Drawing Sheets

TOY IMPLEMENTS FOR STORING AND STRIKING PLAY BALLS

BACKGROUND OF INVENTION

1. Field of Invention

This invention relates generally to hand-held toy implements such as a baseball bat, a tennis racket or a golf club, adapted to strike a play ball, and more particularly to a hollow implement of this type having a storage cavity for receiving the play ball or a weighted insert or other article that can be accommodated in the cavity.

2. Status of Prior Art

Toy hollow baseball bats are known which are designed to be used by young children incapable of handling a regulation bat. Though resembling a standard baseball bat, these hollow toy bats, which are blow-molded or otherwise formed of synthetic plastic material, and are much lighter in weight. Sometimes the diameter of the toy bat is greater than that of a conventional bat so that the child is then more likely to connect with a ball. While the light weight of the bat makes it easier for a young child to handle, it lacks the striking power of a heavier bat and the player therefore may not be able to hit a ball more than a short distance. For a young player who has the strength to handle a somewhat heavier bat, the usual light-weight hollow bat leaves much to be desired.

Hollow toy baseball bats are often used with toy baseballs that simulate a standard baseball in size and appearance but are softer and lighter so as to avoid injury should a child be struck with the toy ball. The practical problem that arises with toy bats and balls is that unless they are stored in a common box, the child is likely to misplace or lose the balls and is therefore unable to play with the bat. A bat is more conspicuous and therefore harder to misplace. And even if the balls are not lost and the child then wishes to take toy bats and a set of balls to a playground, he needs a separate carrier for the balls. There then is a fair chance that the child might lose the carrier on his way to or from the playground.

The same problems are encountered with golf clubs or tennis rackets in toy form for small children, for here too the implement may lack adequate heft and the balls used therewith are easily lost.

SUMMARY OF INVENTION

In view of the foregoing, the main object of this invention is to provide a hand-held hollow toy implement for striking balls, the implement, whether a baseball bat, a golf club or a tennis racket, having a removable head section which when removed exposes a cavity in a hollow shank section in which the balls may be stored before and after play.

A significant advantage of this invention is that when the toy is not in use, the balls may be stored in the play implement and therefore cannot be misplaced unless the implement is lost. The assembly of implement and balls may be conveniently carried to and from a playground without any danger that the balls will be lost.

Also an advantage of the invention is that one may insert into the cavity of the shank section of the implement a weighted insert which imparts greater heft to the implement to enhance its striking power, the weight of the insert being appropriate to the player's requirements. And small articles of clothing can also be stuffed into the cavity so that the bat when not in use acts as a carrier.

Yet another object of the invention is to provide an implement of the above type which includes shank and head sections, yet is fabricated from a single piece of material, thereby reducing manufacturing costs.

Briefly stated, these objects are attained in a hand-held hollow toy implement such as a toy baseball bat, adapted to store as well as to strike a play ball. To manufacture this implement, it is molded from a single piece of light-weight material to define a hollow shank section having a cavity therein, the shank section being provided with a handle at its lower end and a neck at its upper end functioning as one element of a two-element coupler, and a head section whose configuration is dictated by the end use of the implement, the head section being provided at its lower end with the complementary second element of the coupler.

In the manufactured piece, the upper end of the shank section is joined by a collar integral therewith to the lower end of the head section. The manufactured piece is converted into the toy implement by cutting off the collar to separate the head section from the shank section, thereby exposing the cavity and making it possible to intercouple the sections. The cavity is usable to store one or more playballs, a weighted insert to impart heft to the implement, or other small articles.

BRIEF DESCRIPTION OF DRAWINGS

For a better understanding of the invention as well as other objects and further features thereof, reference is made to the following detailed description to be read in conjunction with the accompanying drawings, wherein.

DETAILED DESCRIPTION OF INVENTION

Baseball Bat

Figure 1:
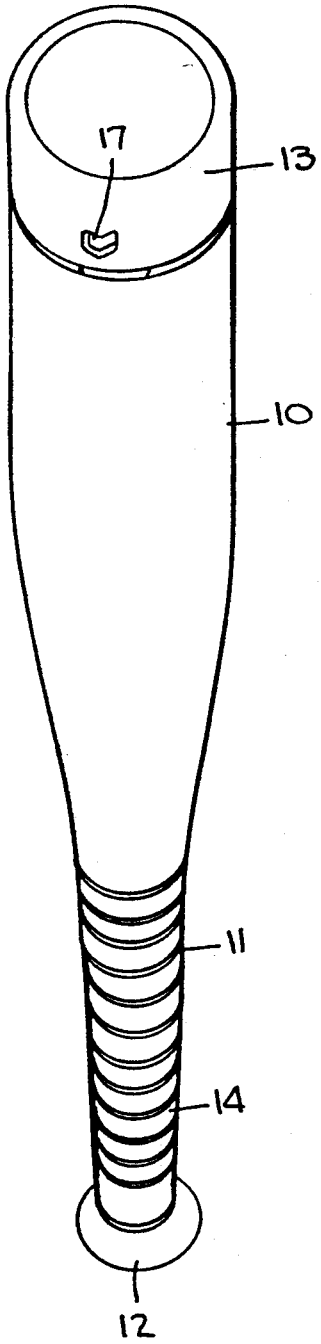
FIG. 1 illustrates, in perspective, a hollow toy baseball bat in accordance with the invention, which consists of a shank section and a removable head section.

Referring now to FIG. 1, illustrated therein is a hollow toy baseball bat in accordance with the invention, the bat being adapted to strike a baseball. The bat includes a hollow shank section 10 contoured to define at its lower end a handle 11 terminating in an end flange 12. The bat is completed by a cylindrical cap constituting a head section 13 removably coupled to the shank section. Handle 11 is molded so as to simulate on its outer surface a tape 14 wound thereabout, as in a standard baseball bat. In practice, an actual adhesive tape may be wound about the handle to render it more realistic in appearance.

Figure 2:
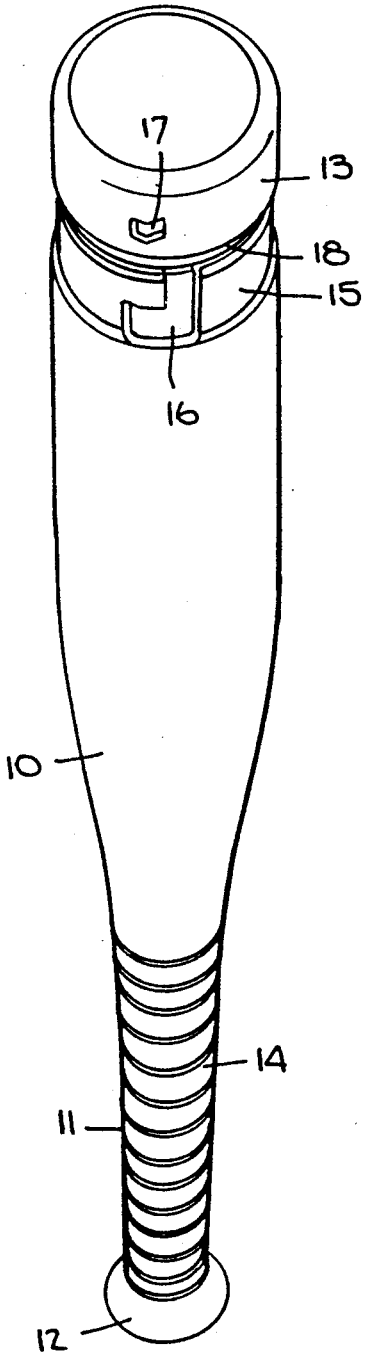
FIG. 2 shows the molded single piece form of the manufactured bat before it is separated into sections.

To manufacture this baseball bat, it is preferably molded, as shown in FIG. 2, as a single piece of material to reduce manufacturing costs. The single piece may be blow or roto-molded from a synthetic plastic material, such as fiber-reinforced nylon or polypropylene so that the bat, though light-weight, is of high strength and can survive rough handling by a child.

Figure 3:
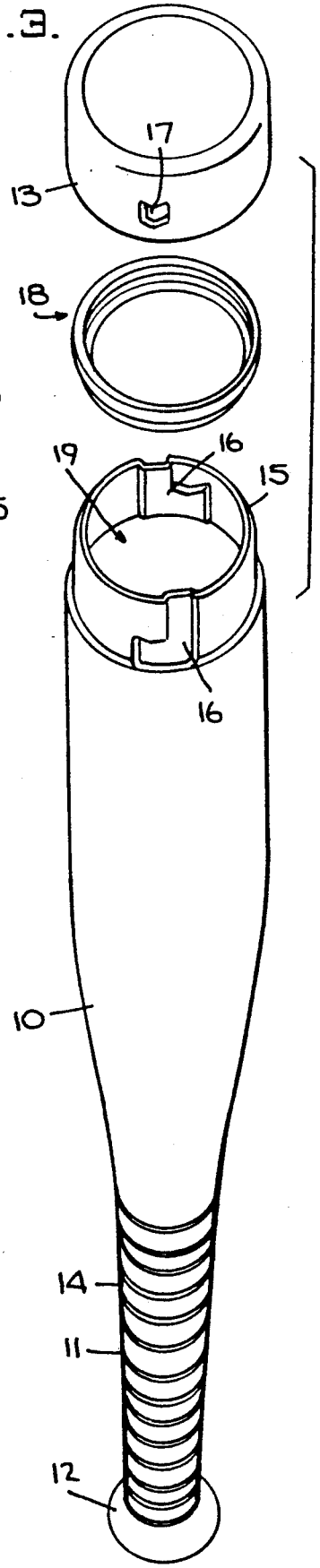
FIG. 3 is a perspective view of the head section, the severed collar and the shank section.
Figure 4:
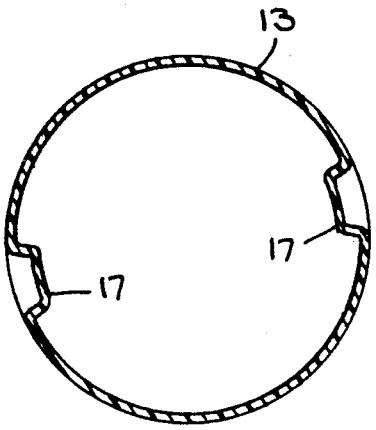
FIG. 4 is a section taken through the head section.

In FIG. 2 it will be seen that at the upper end of shank section 10 is a cylindrical neck 15 of reduced diameter provided with L-shaped indentations 16 on diametrically opposed sides, the neck functioning as one element of a two element coupler. The cylindrical head section 13, as shown separately in FIGS. 3 and 4, is provided with U-shaped indentations 17 serving as the second and complementary element of the coupler. The head indentations 17 are receivable into complementary indentations 16 on the neck at at the upper end of the shank section when the head section is fitted onto the shank section. The coupler in this case is of the bayonet type, and when indentations 17 ride down the vertical leg of indentations 16 and the head section is then twisted to cause indentations 17 to slide into the horizontal leg of indentations 16, the coupler is then locked. To decouple the head section from the shank section, the head section is then twisted in the reverse direction.

Figure 5:
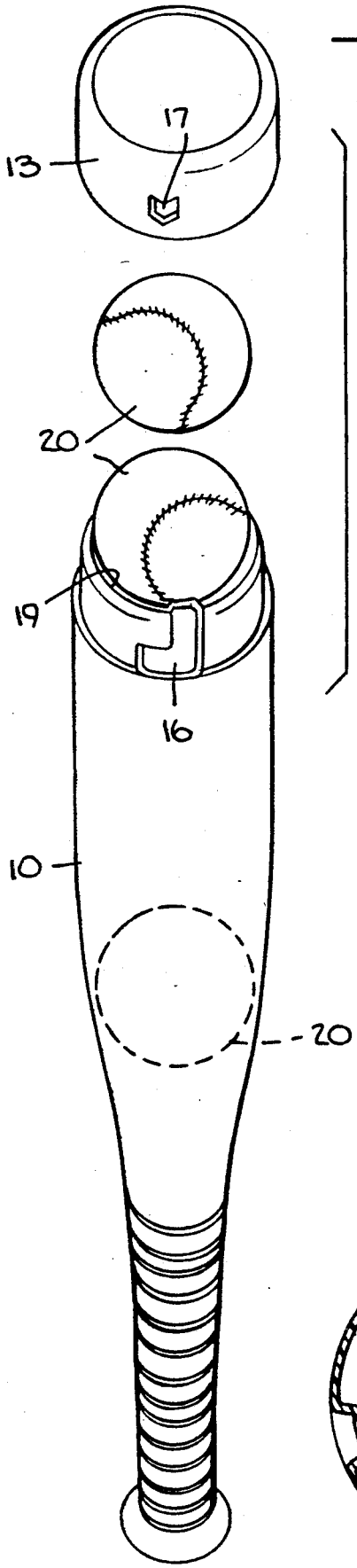
FIG. 5 is an exploded view of the toy bat, showing the manner in which baseballs are loaded into the hollow shank section.

In the manufactured single piece structure, interposed between the upper end of shank section 10 and the lower end of head section 13 and integral therewith is a cylindrical collar 18 which is relatively thin and easily severed. This collar is cut off to separate shank section 10 10 from head section 13, thereby exposing the hollow of the shank section which defines a storage cavity 19, as shown in FIG. 3. As shown in FIG. 5, into cavity 19, one may deposit one or more toy baseballs 20, depending on the capacity of the cavity, and then enclose the cavity by coupling head section 13 onto shank section 10.

Now the child has a baseball bat and ball assembly which he can store in his playroom, so that the balls cannot be misplaced. Or the assembly can be carried to and from a playground without the need for a separate carrier for the balls. While the toy bat may be used with regulation baseballs, use is preferably made of toy baseballs that resemble a standard baseball but are lighter and softer. Also, this cavity can be used to store small articles of clothing. Thus a child may stuff the cavity with a T-shirt or a fabric baseball cap.

Figure 6:
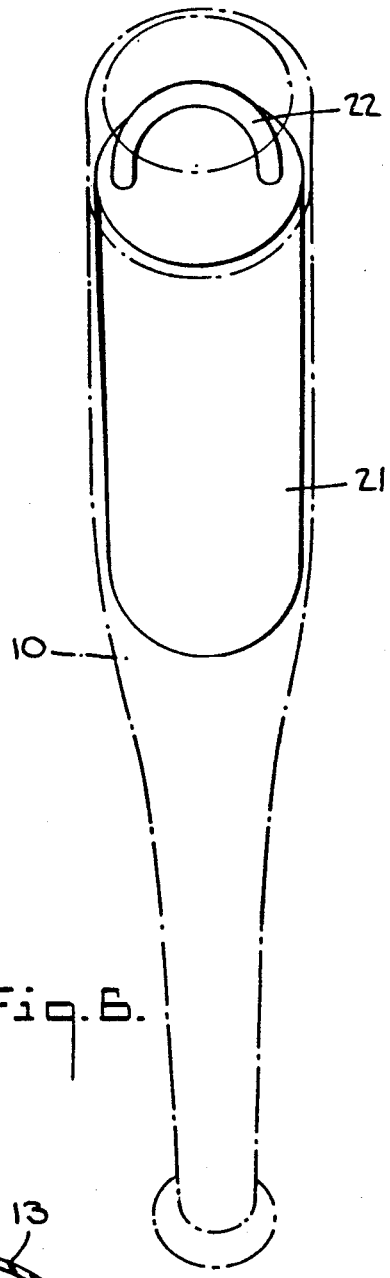
FIG. 6 illustrates a weighted insert which may be disposed in the shank section to impart heft to the toy bat.

A child playing with the toy bat may find, because of its light weight, that it lacks sufficient heft to strike a baseball so that it is propelled more than a short distance. To enhance the heft of the bat, use is made of a weighted insert 21, as shown in FIG. 6, provided at its upper end with a small handle 22. This insert is shaped so that it conforms to the geometry of cavity 19 in the shank section. By placing 21 in the cavity, one then imparts greater heft to the bat. In practice, the insert may be molded of a solid, relatively heavy plastic material. A family of inserts all having the same shape but different weights may be provided whereby the child can then choose an insert of a weight that is accommodated to his ability to handle the toy bat.

The invention is not limited to implements in the form of a baseball bat, for it is applicable to other ball-striking implements for children. In the examples of such implements which are given below, the implements are manufactured in single piece form to define s shank section joined by a severable collar to a head section which is configured to the end use for which the implement is intended. Although not illustrated herein, if the implement is a paddle for table tennis, then the head section will be in paddle form and the hollow shank section will be adapted to store ping pong balls.

Golf Club

Figure 7:
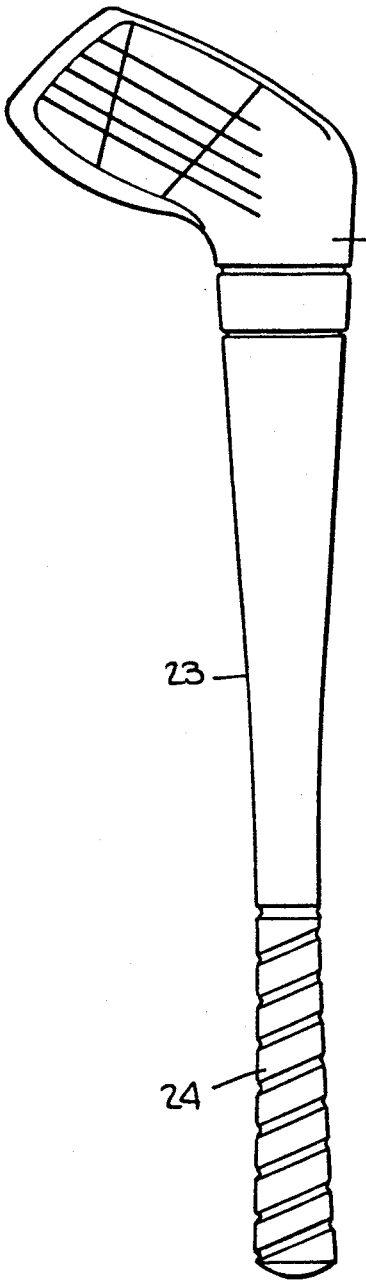
FIG. 7 illustrates a toy golf club in accordance with the invention.
Figure 8:
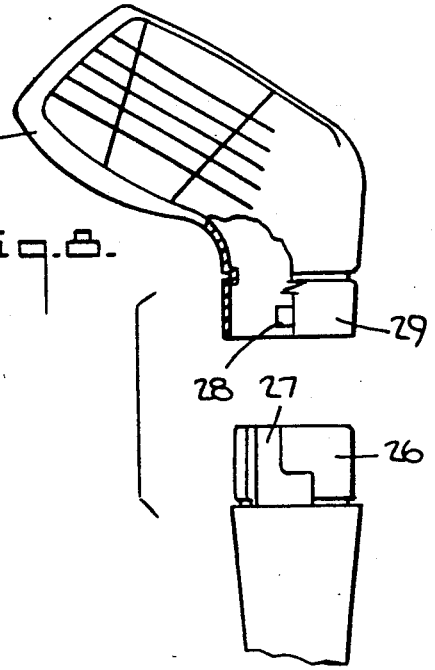
FIG. 8 shows the blade-like head section of the golf club, partly in section, separated from the shank section of the club.

As shown in FIGS. 7 and 8, a toy implement in golf club form consists of a hollow shank section 23 having a handle 24, and a blade-shaped head section 25 adapted to strike a golf ball.

In this arrangement, neck 26 at the upper end of shank section 23 forms one element of a bayonet-type coupler and has an L-shaped slot 27 adapted to receive an internal lug 28 on the cylindrical lower end 29 of head section 25 of the golf club.

When neck 26 of the shank section is telescoped within the lower end of head section 25, the head section is then twisted to lock lug 28 in place. To decouple the head section from the shank section so that one may deposit golf balls in the cavity in the shank section, the head section is twisted in the reverse direction and then withdrawn from the shank section to expose the cavity therein.

The invention is not limited to the particular form of couplers disclosed herein, and two-element couplers of the snap-in or of the threaded type may be used, one element being on the upper end of the shank section and the complementary element on the lower end of the head section.

Tennis Racket

Figure 9:
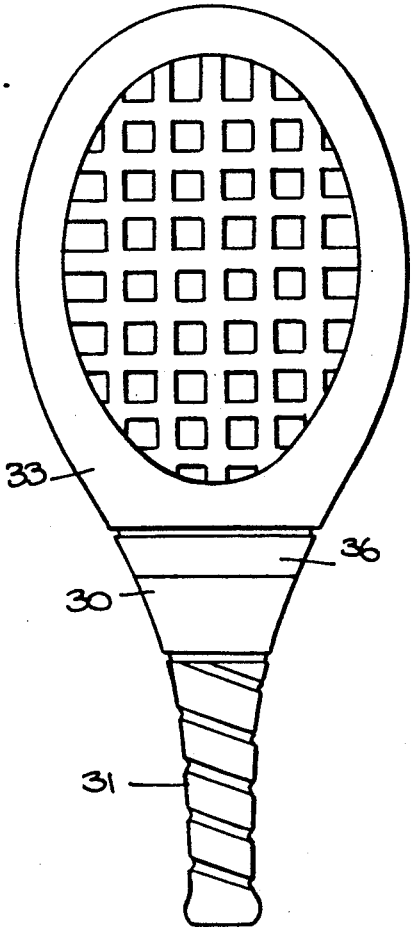
FIG. 9 shows a toy tennis racket in accordance with the invention.
Figure 10:
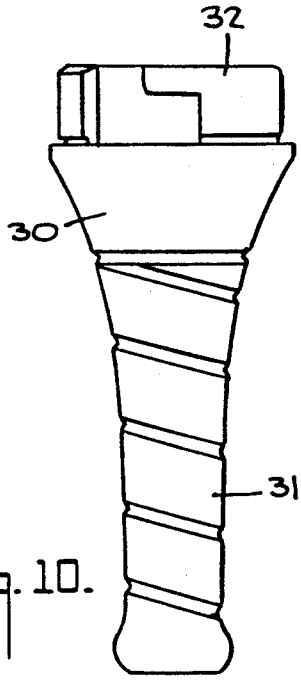
FIG. 10 shows the shank section of the tennis racket.

In the toy tennis racket shown in FIGS. 8 and 9, the hollow shank section 30 which is provided with a handle 31, has at its upper end a neck 32 which forms one element of a bayonet-type coupler similar to that in the above-disclosed golf club. Head section 33 of the tennis racket is molded to define an oval hoop 34 adapted to accommodate a molded net insert 35 which snaps into or is otherwise joined to the hoop. Lower end 36 of head section 33 has an internal lug thereon, as in the golf club, to form the complementary second element of the coupler. Thus while the tennis racket may be manufactured as a single piece that includes a severable collar, an additional net element is required to complete the racket.

The cavity in shank section 30 is dimensioned to accommodate a tennis ball, which in practice may be smaller than a standard ball and is formed, for example, of solid flexible foam plastic material.

While there has been shown and described preferred embodiments of toy implements for storing and striking play balls in accordance with the invention, it will be appreciated that many changes and modifications may be made therein without, however, departing from the essential spirit thereof.

I claim:

1. A hand-held hollow toy implement adapted to strike a play ball and to store this play ball or other objects, said implement comprising:

(a) a hollow shank section having a storage cavity therein whose dimensions are adapted to accommodate said play ball and having at its lower end a handle, said shank section having a cylindrical neck at its upper end having a predetermined diameter that functions as one element of a two-element coupler; and (b) a head section having a configuration dictated by the end use of the implement, the head section being provided at its lower end with the second and complementary element of the coupler, which is cylindrical and is adapted to receive said neck to complete the implement, whereby when the head section is decoupled from the shank section, the cavity is exposed and one may then deposit therein the play ball or other object, said toy implement being fabricated from a single piece of moldable, synthetic plastic material in which integral with the head section and the shank section and interposed therebetween is a severable cylindrical collar that when cut off and discarded separates the shank section from the head section.

2. An implement as set forth in claim 1 having the form of a baseball bat in which the shank section has the shape of this bat and the head section is dome-shaped to complete the bat shape, said cavity being adapted to accommodate a baseball.

3. An implement as set forth in claim 2 further comprising a weighted insert said insert being shaped to conform to the cavity and being adapted to enhance the heft of the bat.

4. An implement as set forth in claim 1, having the form of a golf club in which the head section has the shape of a golf club blade, said cavity being adapted to accommodate a golf ball.

5. An implement as set forth in claim 1, having the form of a tennis racket, the head section having a hoop configuration which is adapted to accommodate a net insert, said cavity being adapted to accommodate a tennis ball.

6. An implement as set forth in claim 1, wherein said one element of said coupler is formed on a cylindrical neck in the upper end of the shank section, which neck is telescoped within the lower end of the head section which is provided with the second element.

7. An implement as set forth in claim 6, wherein said coupler is of the bayonet type.

* * * * *